US005638046A

United States Patent [19]

Malinowski

[11] Patent Number: 5,638,046

[45] Date of Patent: Jun. 10, 1997

[54] SECURITY SYSTEM

[76] Inventor: Robert Malinowski, 29 Weathervane Dr., Leominster, Mass. 01453

[21] Appl. No.: 387,555

[22] Filed: Feb. 13, 1995

[51] Int. Cl.[6] ..... G08B 1/08

[52] U.S. Cl. ..... 340/539; 340/531; 340/506; 340/825.49

[58] Field of Search ..... 340/539, 531, 340/506, 825.49, 825.36

[56] References Cited

U.S. PATENT DOCUMENTS

| | | | |
|---|---|---|---|
| 3,848,231 | 11/1974 | Wootton | 340/539 |
| 4,191,948 | 3/1980 | Stockdale | 340/539 |
| 4,218,763 | 8/1980 | Kelley et al. | 340/539 |
| 4,422,068 | 12/1983 | Helft et al. | 340/506 |
| 4,462,022 | 7/1984 | Stolarczyk | 340/539 |
| 4,511,887 | 4/1985 | Fiore | 340/539 |
| 4,581,606 | 4/1986 | Mallory | 340/539 |
| 4,651,143 | 3/1987 | Yamanaka | 340/521 |
| 4,672,365 | 6/1987 | Gehman et al. | 340/539 |
| 4,772,876 | 9/1988 | Laud | 340/539 |
| 4,797,657 | 1/1989 | Vorzimmer et al. | 340/541 |
| 4,839,631 | 6/1989 | Tsuji | 340/541 |
| 5,160,915 | 11/1992 | Kiss | 340/552 |
| 5,166,664 | 11/1992 | Fish | 340/539 |
| 5,268,670 | 12/1993 | Brasch et al. | 340/541 |
| 5,319,698 | 6/1994 | Glidewell et al. | 340/539 |

*Primary Examiner*—Donnie L. Crosland
*Attorney, Agent, or Firm*—Blodgett & Blodgett, P.C.

[57] ABSTRACT

A security system for determining intrusion status in a defined area. The system uses a sensor unit, a transmitter, and a receiver. The transmitter sends a unidirectional repetitive coded signal to the receiver. The receiver is capable of receiving the signal, decoding it and displaying the intrusion status to a display. The transmitter uses a novel electric connection and orientation in which the sensor and status decoder is electrically connected to a detection memory, an encoder and transmission control unit is electrically connected to a status collector, and a radio frequency transmitter is electrically connected to an encoder and transmission control unit. The unit provides sophisticated intrusion status detection based on the combination of the parts, organization and electrical connections. The system avoids false alarms due to the unidirectional and repetitive coded signal which is sent to and from the transmitter to the receiver. The transmitter is able to transmit a continuous and repetitive signal which is received by the receiver to give the intrusion status up to the nearest second.

13 Claims, 3 Drawing Sheets

SECURITY SYSTEM

BACKGROUND OF THE INVENTION

The present invention is directed generally to a security system, and more specifically to a security system having a sensor, a unidirectional signaling and passive transmitter and a receiver unit.

A variety of security systems and personal monitoring systems presently exist.

In one class of monitoring systems the transmitter unit is carried as an active device by a person or employee. The signal from the transmitter may be received by the sensor unit which may indicate that a person or object is going through a door or similar portal. Once the sensor has picked up the signal, it relays a second signal to an alarm or similar type device.

In a second class of security systems or personal monitoring systems, a user or person carries a passive device which receives signals and retransmits the signals when the person is in a predetermined range of a transmitter. Still other devices rely upon a pressure pad which may be stepped upon, or triggered by the opening of a door.

These personnel and security systems have several disadvantages, such as: (1) they do not provide advanced warning that a monitored person may be about to go through a passageway; (2) the systems can be defeated by a person who quickly proceeds through a passageway; (3) the systems are often susceptible to failure due to the monitoring capability of the system, and timing intervals between sensing by the sensor and relay from the transmitter to the receiver; (4) the system uses a variety of transmission signals from sensor to transmitter to receiver; (5) the systems are dual direction signalling in transmission and lack specificity in the actual signal which is transmitted and therefore, in many cases, fail due to a temporary malfunction because of inadequate warning, confusion of signals, or interferences by unrelated signals in the vicinity. These and other difficulties experienced with the prior art devices have been obviated in a novel manner by the present invention.

It is therefore, an outstanding object of the invention to provide a security system which is wireless and which utilizes a one way signal transmission from sensor to transmitter to receiver.

Another object of this invention is the provision of a security system in which the user passively carries the receiving unit while the transmitter unit and sensor are stationed in a defined area to be monitored.

A further object of the present invention is the provision of a security system which can minimize the possibility of bodily harm to a home owner who is unexpectantly confronted by an intruder.

It is another object of the present invention to provide a security system which operates passively to avoid alerting the intruder that he has been detected by a sensor unit.

A still further object of the invention is the provision of a security system which provides a sole and unidirectional transmission signal from a radio frequency transmitter to a receiver unit.

It is a further object of the invention to provide a security system with a sensor, a transmitter having a detection memory, status collector, encoder and radio frequency transmitter which can encode and transmit a defined and encoded signal and which can be received only by a receiver capable of decoding the encoded radio frequency transmission.

With these and other objects in view, as will be apparent to those skilled in the art, the invention resides in the combination of parts set forth in the specification and covered by the claims appended hereto.

SUMMARY OF THE INVENTION

A security system having a sensor, transmitter, and receiver. The sensor means detects a moving person within a designated detection zone and is capable of formatting and encoding such detection into an encoded data format for transmission. A transmitter means receives the encoded data and generates a coded unidirectional radio frequency signal. The receiver means receives, demodulates, decodes and displays the intrusion status of the coded unidirectional signal from the transmitter. The receiver means is carded by the homeowner or employee.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
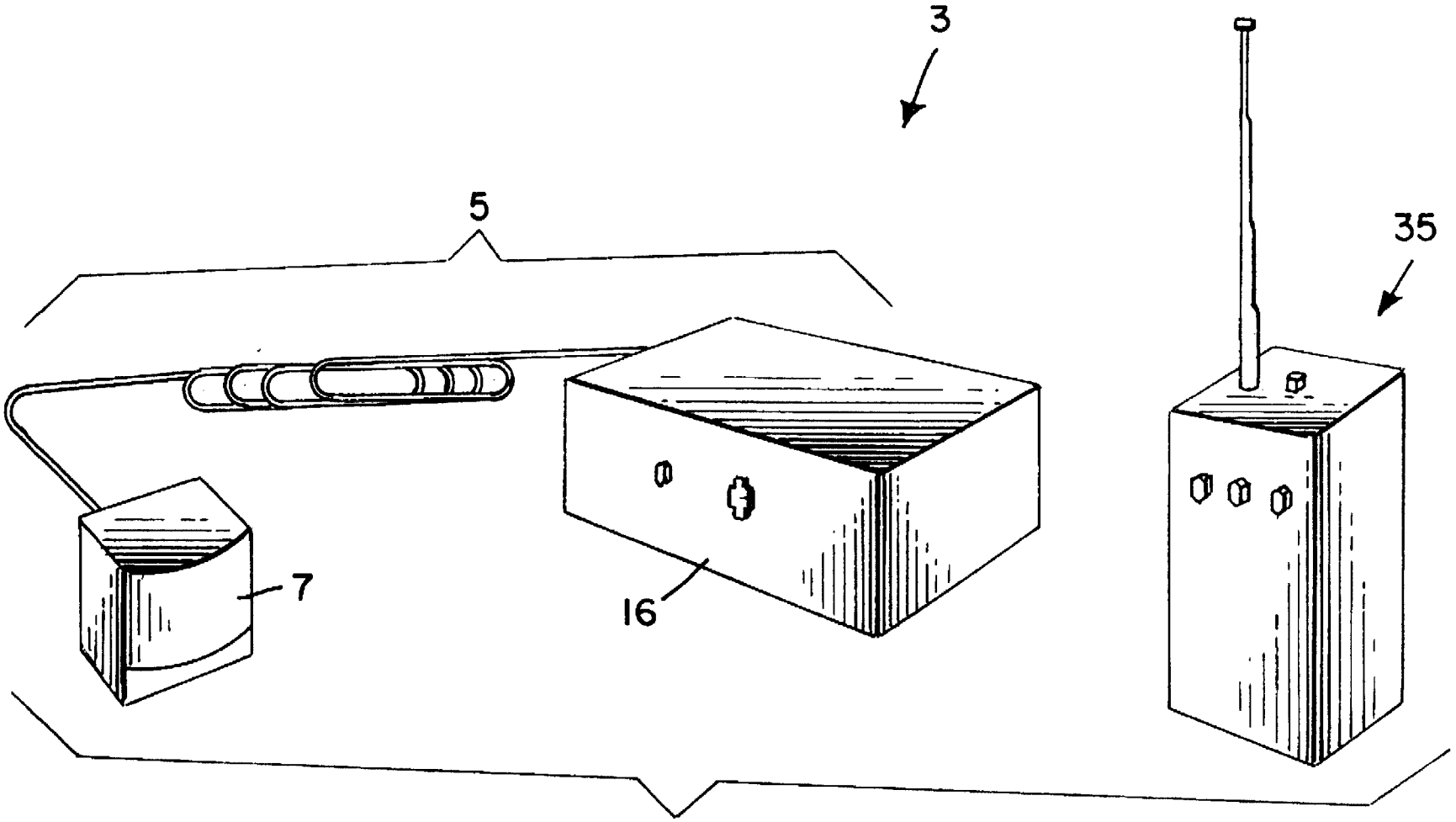
FIG. 1 is a perspective view of the present invention and security system.

FIG. 1 shows a sensor/transmitter unit 5 and radio frequency receiver unit 35, respectively, which together form a portable wireless sensor security system 3 that enables a user to monitor the intrusion status of a detection zone from a nearby location. The sensor/transmitter unit 5 includes a sensor 9 and a transmitter 16 For the general public, this detection zone would most likely be the high traffic paths in a home, apartment, or hotel room. To increase the safety of the user and minimize tampering, detection of the intruder does not produce any visual or audible signals. The security system 3 adds further protection through utilization of periodic radio frequency-linked digital messages to provide unseen detection notification of hostile intruders who may be familiar with the physical aspects of the premises.

The sensor/transmitter unit 5 will remember a detection event for an adjustable period of time, before recycling. Another detection event will restart the detection memory reset cycle. This creates a moving time frame or short term historical record of detection activity. Intrusion status, as a minimum, is one of the following:

a. No detections occurred within the last adjustable time frame.

b. Detection occurred within the last adjustable time frame.

c. Detection presently is occurring.

Given the possibility of there being more than a single sensor/transmitter unit 5 located in a designated reception area, the security system 3 employs a security code block (Tx) for transmitter unit 16 for holding security codes for validation of transmitted messages, and variable transmission frequency to extend usefulness of security codes. For a message to be valid, the reception frequency and security code of the radio frequency receiver unit 35 must match those of the sensor/transmitter unit 5.

The sensor/transmitter unit 5 operates continuously whether or not the user is present. If the user is present in the detection zone and decides to leave and return before the sensor/transmitter unit 5 performs its normal periodic cycling, the user may manually activate a signal which informs the unit to execute its otherwise normal cycle after an adjustable delay period that affords the user sufficient time to evacuate the detection zone. When the user returns, the radio frequency receiver unit 35 will then indicate the correct intrusion status.

The battery powered radio frequency receiver unit 35 held by the user, when in reception range of the sensor/transmitter unit 5, indicates intrusion status; or lack of reception, when that is the case. To increase transmission reliability, the radio frequency receiver unit 35 must receive two identical sequential messages before it will acknowledge a valid message reception and post intrusion status.

Sensor/Transmitter Unit

Figure 2:
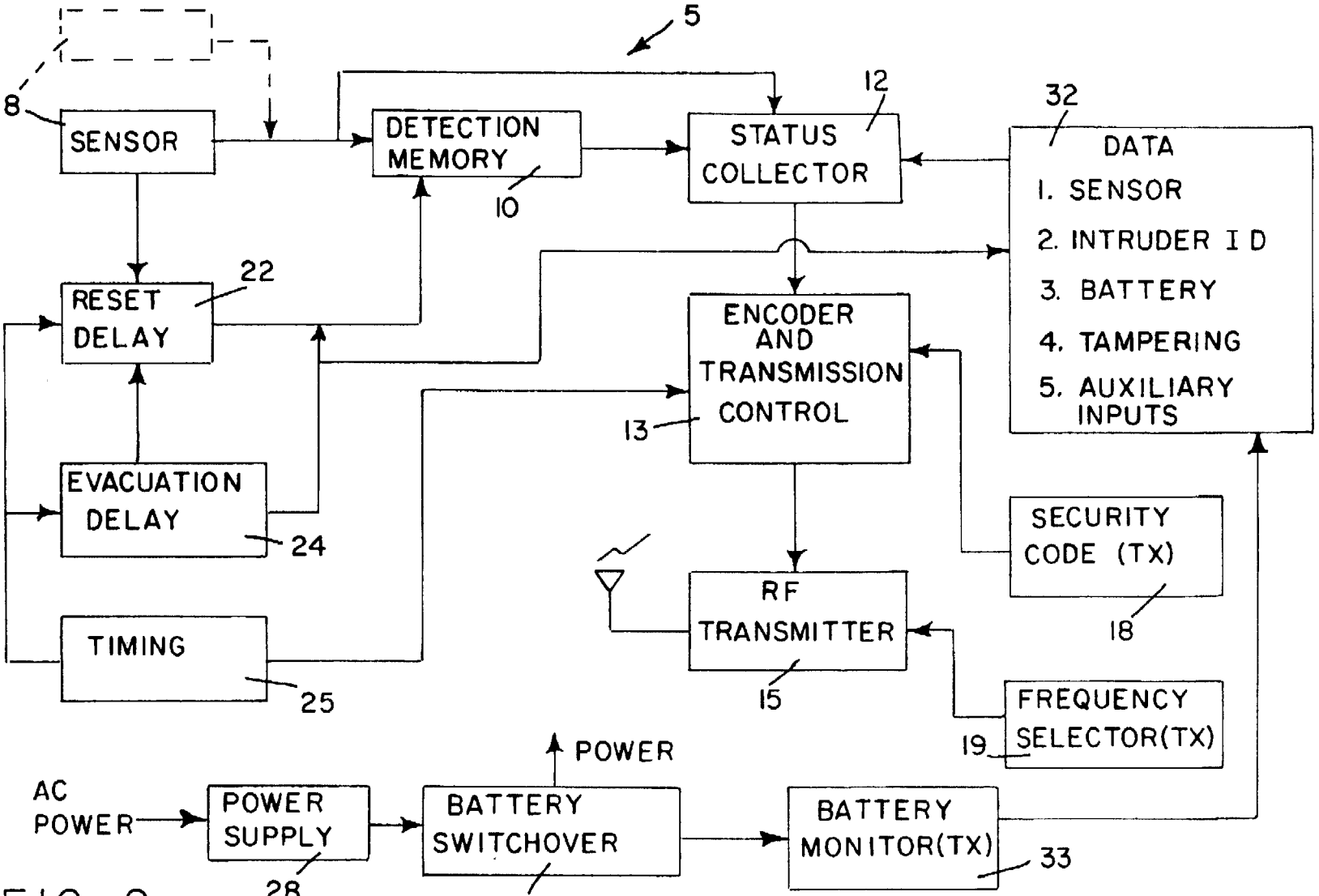
FIG. 2 is a block diagram of an electrical system showing the sensor and transmitter that may be used in the embodiment of FIG. 1.

The sensor/transmitter unit 5 as shown in FIG. 2 performs the following functions:

1. Detects a moving person within a detection zone and formats the detection for digital processing.
2. Remembers the detection event for an adjustable period of time after the detection.
3. Collects intrusion status and available system data.
4. Encodes the intrusion status such that:
   a. No detection(s) occurred within the last adjustable time frame.
   b. Detection(s) occurred within the last adjustable time frame.
   c. Detection(s) presently is/are occurring.
5. Encodes available system data.
6. Encodes a security code which the radio frequency receiver unit will use to validate a message.
7. Sets the radio transmission frequency.
8. Allows the user, at his option, to activate a signal to cycle the sensor/transmitter unit, but with an execution delay the user finds sufficient to evacuate the detection zone.
9. Controls sequencing of the above functions and periodic radio frequency transmissions.
10. Provides DC power from AC line voltage, and changes over to battery power during external power outages.

Sensor Block

In FIG. 2 the sensor block 8 (there may be more than one as indicated by the dashed box above the sensor block) has as its primary function the detection of a moving person within its detection zone and converting this event into a detection logic level. The sensor 8 passes this logic level to the detection memory block 10, reset delay block 22, and status collector block 12. To maintain the portability of the security system 3, these communication links may be a direct connection requiring no permanent installation, a radio link generated by a portable sensor 8, or via AC electrical wiring. Two or more sensors 8 may be used to extend detection coverage by connection in series, by connection to separate ports, or in parallel. The security system 3 is also capable of periodically checking the integrity of the communication links.

The sensor block 8 sends its status to the data block 32, if the sensor 8 supplies such data. If a fault condition arises and the sensor 8 does not supply status to the data block 32, the sensor block 8 defaults, when possible, to a constant detection logic level.

If one disconnects a sensor block 8 from the system, the security system 3 loses its ability to detect the intruders entering the sensor block's 8 detection zone. The data block 32 checks its connection status logic. If the logic state indicates a disconnection, the data block 32 sets a fault condition for the disconnected sensor 8. The reset delay block 22 will continue to operate normally. The status collector block 12 continues processing the logic levels received.

The security system 3 may use a single passive infrared receiver (PIR) 38 (not shown in drawings) as the sensor block 8. The PIR 38 communicates with the remainder of the system via a direct electrical connection to a tiepoint that distributes the sensor's 8 detection logic level to the detection memory block 10, reset delay block 22, and status collector block 12. The direct electrical connection is the most efficient implementation of the communication link. If the sensor block 8 becomes disconnected, the tiepoint defaults to a constant detection logic level. This action substitutes for the data block's 32 task of determining the connection status of sensor blocks 8. This condition sets detection memory block 10 and inhibits reset delay block 22, which is no longer needed. The status collector block 12 will continue to process the logic levels received. The logic levels in this situation represent a constant active detection. Since the data block 32 in FIG. 3 normally indicates active detection only when detection is actually occurring, the constant display of an active detection serves to warn the user. Upon reconnection of the sensor block 8, the reset delay block 22 will again function normally and clear detection memory block 10 at the predetermined recycle time, and the constant active detection indication will cease.

Detection Memory Block

The detection memory block 10 receives detection logic level data from the sensor block 8 via appropriate interfacing and stores this data in its memory. The data will reside in memory until cleared by the reset delay block 22 or the evacuation delay block 24. Depending on the setup, detection memory block 10 may also maintain a count of detection events and the time of their occurrence.

The security system 3 remembers that a detection event occurred within the last time frame, but not the number and time of occurrence of such events; instead, it simply uses each detection event to restart the reset delay block 22 and thereby creates the moving time frame.

Status Collector

The status collector block 12 formats active detection logic levels received from the sensor block 8, the detection event record from the detection memory block 10, and the system data available from the data block 32. It passes the formatted data to the encoder and transmission control block 13.

The system routes the sensor block's 8 detection logic level and the detection memory block's 10 event record to the status collector block 12. (See the sensor block description for the data supplied by the data block indicator).

Encoder and Transmission Control Block

The encoder and transmission control block 13 has two functions. The first function is to encode the security code supplied by the security code block 18, and data received from the status collector block 12, into a form suitable for radio frequency transmission and reception. The second function is to control the modulation, duration and periodicity of radio frequency transmissions. To improve transmission reliability, the encoder and transmission control block 13 sends three identical sequential messages during a transmission cycle. The radio frequency receiver unit 35 need only decode two sequential messages out of the three messages transmitted, to verify a valid transmission. The timing block 25 supplies the basic timing information.

The system pulse-amplitude-modulates a CW transmitter 46 (not shown in drawings). Message transmission duration and periodicity are approximately 0.3 seconds and 2 seconds, respectively.

Radio Frequency Transmitter Block

The radio frequency transmitter block 15, when enabled, generates radio frequency energy with a carrier frequency determined by the frequency selector block 19. The encoder and transmission control block 13 controls the carrier's duration and periodicity, and supplies the modulation waveform. The frequency selector block 19 supplies the transmission frequency data.

The system employs an externally enabled low power LC oscillator as the radio frequency transmitter 16. (See FIG. 1)

Security Code Block (Tx)

The security code block (Tx) 18 enables the radio frequency receiver unit 35 (FIG. 1), tuned to the transmission frequency of a sensor/transmitter unit 5 to identify a valid message transmission. This block routes the selectable security codes to the encoder and transmission control block 13.

Disconnection of the security code block (Tx) 18 disables identification of transmitted messages. The radio frequency receiver unit 35 rejects messages with security codes not matching its own.

The system routes tri-state logic levels to the encoder and transmission control block 13.

Frequency Selector Block

The frequency selector block 19 provides the means to select the radio frequency transmission frequency. This block routes frequency information to the radio frequency transmitter block 15.

The frequency selector block 19 uses an adjustable capacitor (not shown in drawings) to set radio frequency transmission frequency.

Reset Delay Block

The reset delay block 22 clears the detection memory block 10 after an adjustable time delay has elapsed. If a detection logic level arrives from the sensor block 8, the block restarts the time delay.

The reset delay block 22 offers selectable delays of (30) thirty, (60) sixty, (90) ninety, and infinite minutes.

Evacuation Delay Block

The evacuation delay block 24 provides the user a manual control 34 (not shown in drawings) to clear the detection memory block 10 and initialize the data block 32 at a time other than the normal cycle time set by the reset delay block 22. The manual control 34 activates a signal that informs the evacuation delay block 24 to begin the desired command execution after an adjustable delay has elapsed. The evacuation delay block 24 is otherwise inactive.

The security system 3 has an evacuation delay block 24 that has adjustable execution delays of (2) two, (3) three and (4) four minutes, and that illuminates an indicator for the duration of the selected delay.

Timing Block

The timing block 25 contains the clock generation and distribution circuits that govern all sequencing operations of the sensor/transmitter unit 5. The timing block 25 delivers clocks to the reset delay block 22, evacuation delay block 24, encoder and transmission control block 13, and data block 32.

Power Supply Block

The power supply block 28 converts AC line voltage to regulated DC voltage and limits electrical current during overload conditions.

Disconnection of the power supply block 28 forces the sensor/transmitter unit 5 to operate on power provided by the battery switchover block 29.

Battery Switchover Block

The battery switchover block 29 contains a battery and monitors the DC voltage produced by the power supply block 28. When the monitored voltage falls below a reference level, this block selects the battery as the backup power source.

Data Block

The data block 32 represents optional enhancements to the sensor/transmitter unit 5. The data block 32 sends logic levels to the status collector block 12, representing system information concerning sensor status, intruder identification, battery condition, tampering, and auxiliary inputs. The evacuation delay block 24, when activated, clears any temporary information stored. The timing block 25 supplies the basic timing information for any data block 32 operations.

Multiple users of a single security system 3 might wish to inform each other of an intruder. The occupant first entering a detection zone enters an identification code. This identification code, when matched against a stored internal code, sets a logic level to be transmitted to the radio frequency receiver unit 35. The entered code deactivates after an adjustable delay or when the data block 32 receives a cycle command from the evacuation delay block 24.

The condition of the battery switchover 29 informs the user of the system whether the sensor/transmitter unit 5 will function properly during an external power outage. The data block 32 receives a power status logic level from the battery monitor block 33 and passes it to the status collector block 12 by means of data block 32. A failure sets a logic level to be sent to the status collector block 12.

An auxiliary system (not shown), such as silent burglar alarm system, could supply information to be passed along to the radio frequency receiver unit 35. The data block 32 would then include appropriate interfacing and timing to accomplish this.

The security system 3 uses the data block 32 in defined ways to determine sensor and battery status.

The first method is a common tiepoint that monitors the sensor block 8 connection status for tampering.

The second method utilizes a passive infrared receiver (PIR) 38 as the sensor block 8. During a power outage, the PIR 38 malfunctions when the battery voltage is too low and outputs a default logic level at the same tiepoint. The radio frequency receiver unit 35 displays this fault condition.

Battery Monitor Block (Tx)

A battery monitor block (Tx) for transmitter unit 33 checks the battery, which is contained in the battery switchover block 29, for a voltage level required for proper operation of the sensor/transmitter unit 5 during external power outages. The battery monitor block 33 sends a battery status logic level to the data block 32 for consolidation with other data and, given a defective battery, illuminates a designated indicator. This indicator visually informs the user of the battery's need for replacement.

The system contains a battery monitor block 33 that does not pass the battery status logic level to the data block 32 but does illuminate an indicator when appropriate.

Radio Frequency Receiver Unit

The radio frequency receiver unit's 35 (FIG. 1 and 3) top level functions consist of the following:

1. Demodulates a transmission when tuned to a sensor/transmitter unit 5 transmission frequency.

2. Extracts code bits from a transmission.

3. Checks for the valid security code and stores valid data (a transmission is valid when the received radio frequency and security code match with the sensor/transmitter unit 5).

4. Decodes the status data bits.

5. Formats status data for presentation to the user.

6. Monitors incoming transmissions and, if none, displays a fault condition.

7. Stores a security code which the radio frequency receiver unit 35 will use to validate a message.

8. Sets the radio frequency transmission frequency.

9. Provides regulated battery power for mobile, handheld operation.

Radio Frequency Receiver Block

Figure 3:
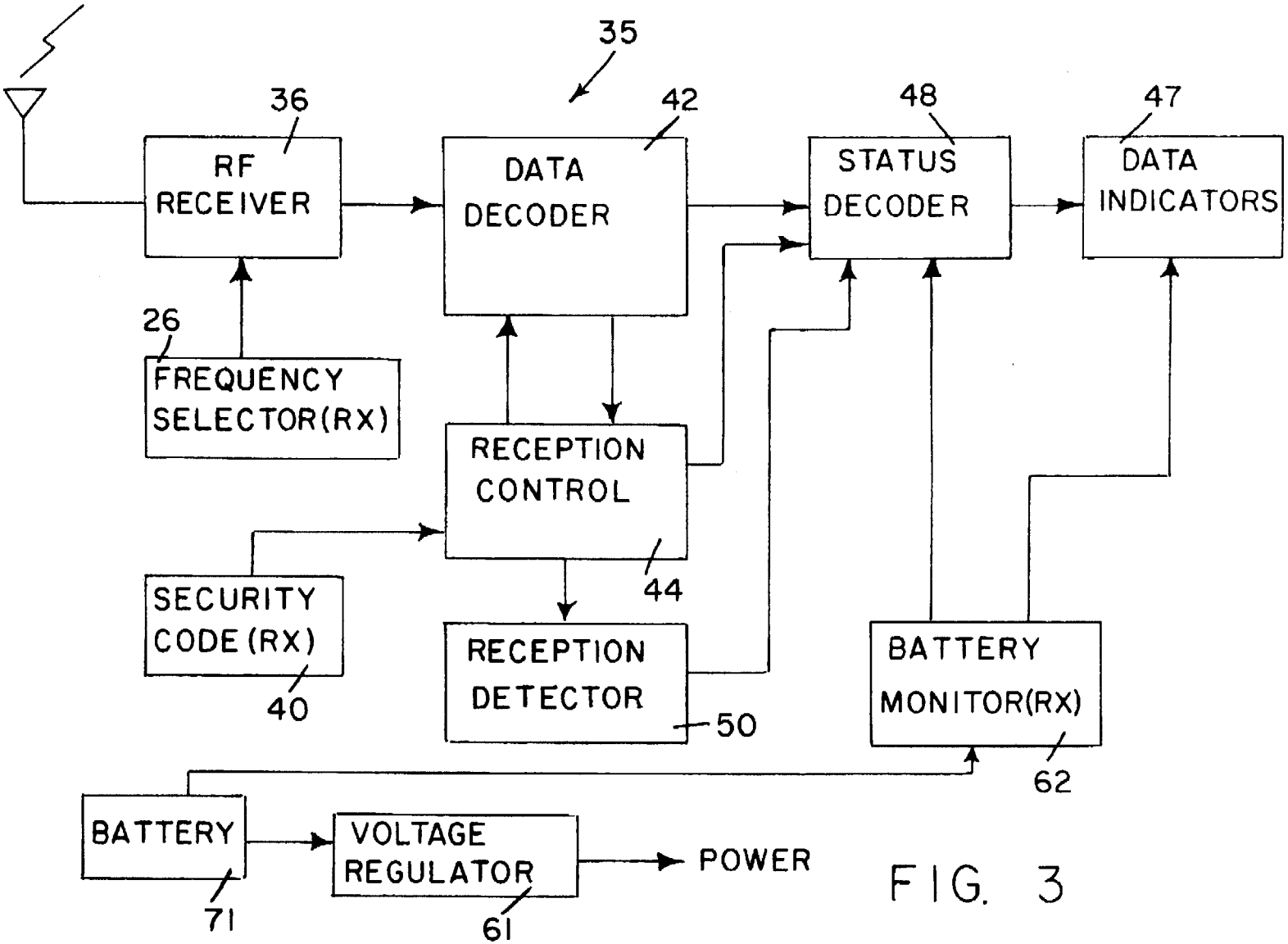
FIG. 3 is a block diagram of an electrical system receiver unit which may be used with the transmitter and sensor depicted in FIG. 2.

Referring now to FIG. 3, the radio frequency receiver block 36, when tuned to a sensor/transmitter unit 5 transmission frequency, demedulates a radio frequency transmission originating with the sensor/transmitter unit 5. The block passes the demodulated data to the data decoder block 42. The frequency selector block (Rx) 26 supplies the reception frequency data.

The system uses an AM receiver to demodulate pulse-amplitude-modulated CW burst transmission.

Data Decoder Block

The data decoder block 42 extracts cede bits from an incoming radio frequency transmission, passes them to the reception control block 44, and waits for instructions from the reception control block 44 when to store cede bits and when to pass the data bits portion to the status decoder block 48. If the message is invalid, reception control tells the data decoder to return to standby mode.

Reception Control Block

The reception control block 44 receives code bits from the data decoder block 42 and compares the security code bits with those supplied by the security code block (Rx) 40. A security code match causes reception control block 44 to issue a command to the data decoder block 42 to store the extracted code bits. If the second sequential security code and data bits match, the reception control block 44 commands the data decoder block 42 to pass the data bits to the status decoder block 48 and informs the status decoder block 48 that the data bits are valid.

This reception control block 44 also notifies the reception detector block 50 that a valid transmission has occurred.

Status Decoder Block

The status decoder block 48, when notified by reception control, will accept data bits passed to it by the data decoder 41. It will decode the data bits for the sensor/transmitter unit 5 status and send formatted status to the data indicators block 47 unless inhibited by a command from the battery monitor block 33.

Data Indicators Block

The data indicators block 47 accepts formatted status from the status decoder block 48 and presents the status to the user. The data indicators block 47 also accepts from the battery monitor block (Rx) 33 an illumination command for a designated indicator to visually inform the user of battery condition.

The data indicators block 47 utilizes light emitting diodes (LEDs) as the presentation medium. The LEDs are color coded to mean the following:

a. Green—No detections occurred within the last adjustable time frame.

b. Yellow—Detection occurred within the last adjustable time frame.

c. Red—Detection presently is occurring.

One of the three LED's will flash briefly after each valid message reception cycle. A battery fault condition continuously illuminates the green LED. The red and yellow LED's will remain extinguished Reception Detector Block The reception detector block 50 monitors the presence or absence of periodic incoming valid message transmissions. The reception detector block 50 remains idle as long as it receives notification of incoming valid transmissions from the reception control block 44. If the notifications cease as would be the case for a disabled sensor/transmitter unit 5 or for the radio frequency receiver unit 35 when located beyond the reception range of the sensor/transmitter unit 5, the reception detector block 50 will time out and send fault data and a valid data command to the status decoder block 48.

The reception detector block 50 contains a reception detector that times out after (5) five seconds and will briefly flash a LED at (5) five second intervals. The reception detector block 50 will return to an idle state upon restoration of valid message reception.

Security Code Block (RX)

The security code block (Rx) 40 enables the radio frequency receiver unit 35 tuned to the transmission frequency of a sensor/transmitter unit 5, to identify a valid message transmission. The security code block (Rx) 40 routes the selectable security code and the tri-state logic levels to the reception control block 44.

Frequency Selector Block (Rx)

The frequency selector block (Rx) 26 provides the means to select the radio frequency. The frequency selector block (Rx) 26 routes frequency information to the radio frequency receiver block 36.

The frequency selector block (Rx) 26 uses an adjustable capacitor (not shown in drawings) to set radio frequency reception frequency.

Battery Block

The battery block 71 provides unregulated power for mobile operation of the radio frequency receiver unit 35. The battery block 71 will also accept connection of external DC power sufficient for proper operation.

Voltage Regulator Block

The voltage regulator block 61 provides the optimum regulated DC voltage required by the circuitry in the radio frequency receiver unit 35.

The voltage regulator block 61 system uses a voltage regulator to prevent erratic operation of the radio frequency receiver unit 35 during high current transients.

Battery Monitor Block (Rx)

The battery monitor block (Rx) 62 checks the battery 71, for a voltage level required for reliable operation of the radio frequency receiver unit 35. If the battery voltage level is inadequate, the battery monitor block (Rx) 62 signals the status decoder block 48 to cease passing data to the data indicators block 47. The battery monitor block (Rx) 62 also sends an illumination command to a designated indicator, within the data indicators block 47, that visually informs the user to replace the battery.

In the system, the radio frequency receiver unit 35 does not have a separate indicator for a low battery voltage condition. If the battery voltage is adequate, one of the indicators will flash at a specific periodic interval. The unit displays a low battery voltage condition with a single constantly illuminated green LED and no status update. The radio frequency receiver unit 35 operation may be checked at any time whether in reception range or not. If in reception range, the indicators will flash the received status at two second intervals. If not in reception range, a green indicator will flash at five second intervals.

It is obvious that minor changes may be made in the form and construction of the invention without departing from the material spirit thereof. It is not, however, desired to confine the invention to the exact form herein shown and described, but it is desired to include all such as properly come within the scope claimed.

What is claimed is:

1. A security system, comprising:

(a) a transmitter for receiving a detection signal, said transmitter having memory means for storing coded data indicative of said detection signal for a predetermined time frame, said memory means being capable of being cleared upon receipt of a reset signal, said transmitter being capable of generating coded unidirectional radio frequency signals which are indicative of current detection of a moving person in a zone, detection of a moving person in said zone within a current time frame and that no detection of a moving person has occurred in said zone during the current time frame;

(b) a timer for generating predetermined time frames, said timer being capable of receiving a detection signal and beginning a new predetermined time frame upon receipt of a detection signal and for generating a reset signal at the end of said predetermined time frame if no additional detection signals are received during said predetermined time frame, said timer being operatively connected to said memory means for transmitting said reset signal to said memory means for clearing said memory means;

(c) at least one sensor for detecting a moving person within a designated detection zone and for formatting and encoding such detection into a detection signal, said sensor being operatively connected to the memory means of said transmitter and said timer for transmitting said detection signal to said memory means and to said timer; and (d) a portable receiver for receiving, demodulating and decoding said coded unidirection radio frequency signals from said transmitter, said receiver having sensory indicator means which provides a first sensory indication of current detection of a moving person in said zone, and a second sensory indication of detection of a moving person in said zone during the current time frame.

2. A security system as recited in claim 1, wherein said current timer is adjustable for adjusting the length of said time frame.

3. A security system as recited in claim 1, wherein said receiver has a first sensory indicator for providing said first sensory indication, a second sensory indicator for providing said second sensory indication and a third sensory indicator for providing said third sensory indication.

4. A security system as recited in claim 3, wherein each of said first, second, and third sensory indicators is a light emitting diode.

5. A security system as recited in claim 3, wherein each of said first, second, and third sensory indicators is a visual indicator and capable of generating light of a specific color which differs from the color of the light which is generated by the others of said sensory indicators.

6. A security system as recited in claim 1, wherein said receiver has a security code identifier and said transmitter has a security code data input means for inclusion of security code data with said radio frequency signals.

7. A security system as recited in claim 1, wherein said transmitter further comprises an evacuation delay means for providing a user a manual control which, upon activation, will delay for a specific delay period the clearing of the memory means, the termination of the current time frame and the start of a new time frame.

8. A security system as recited in claim 7, wherein said evacuation delay means is adjustable for adjusting the length of said delay period.

9. A security system as recited in claim 1, wherein said receiver further comprises a radio frequency selector means.

10. A security system as recited in claim 9, wherein said receiver further comprises a power source for mobile operation of said radio frequency receiver means.

11. A security system as recited in claim 10, wherein said receiver means further comprises a voltage regulator means for providing optimum regulated DC voltage required by circuitry in said radio frequency receiver unit.

12. A security system as recited in claim 1, wherein said receiver includes a lack of valid message reception indicator which provides a fourth sensory indication.

13. A security system as recited in claim 1, wherein said transmitter has manual coded data input means, said transmitter being capable of generating a radio frequency signal which is indicative of coded data, and wherein said receiver is capable of providing a sensory indication which is indicative of said coded data.

* * * * *

UNITED STATES PATENT AND TRADEMARK OFFICE

CERTIFICATE OF CORRECTION

PATENT NO. : 5,638,046

DATED : Jun. 10, 1997

INVENTOR(S) : Robert Malinowski

It is certified that error appears in the above-indentified patent and that said Letters Patent is hereby corrected as shown below:

| | |
|---|---|
| Col. 2, line 14; | delete "carded" and replace with --carried--. |
| Col. 7, line 39; | delete "demedulates" and replace with --demodulates--; |
| line 49; | delete "cede" and replace with --code--; and |
| line 52; | delete "cede" and replace with -- code--. |

Signed and Sealed this

Sixteenth Day of September, 1997

*Attest:*

*Attesting Officer*

BRUCE LEHMAN

*Commissioner of Patents and Trademarks*